US011004636B2

(12) United States Patent
Sheridan

(10) Patent No.: US 11,004,636 B2
(45) Date of Patent: May 11, 2021

(54) ELECTRICAL RELAY WITH MOUNTING BRACKET

(71) Applicant: Albright International Limited, Whitchurch (GB)

(72) Inventor: Michael Sheridan, Whitchurch (GB)

(73) Assignee: Albright International Limited, Whitechurch (GB)

( * ) Notice: Subject to any disclaimer, the term of this patent is extended or adjusted under 35 U.S.C. 154(b) by 231 days.

(21) Appl. No.: 16/169,496

(22) Filed: Oct. 24, 2018

(65) Prior Publication Data

US 2019/0122843 A1 Apr. 25, 2019

(30) Foreign Application Priority Data

Oct. 25, 2017 (GB) ..... 1717557

(51) Int. Cl.

| | |
|---|---|
| ***H01H 45/00*** | (2006.01) |
| ***H01H 45/04*** | (2006.01) |
| ***H01H 50/04*** | (2006.01) |
| ***H01H 51/28*** | (2006.01) |
| *H01H 11/00* | (2006.01) |

(52) U.S. Cl.

CPC ..... *H01H 45/04* (2013.01); *H01H 50/047* (2013.01); *H01H 51/281* (2013.01); *H01H 11/0031* (2013.01); *H01H 50/045* (2013.01)

(58) Field of Classification Search

CPC .... H01H 45/04; H01H 51/281; H01H 50/047; H01H 50/045

USPC ..... 335/202

See application file for complete search history.

(56) References Cited

U.S. PATENT DOCUMENTS

| | | | | |
|---|---|---|---|---|
| 2,190,685 A * | 2/1940 | Slater | H01H 50/76 | 335/91 |
| 4,382,242 A * | 5/1983 | Colvin | H01H 50/023 | 335/131 |
| 8,138,872 B2 * | 3/2012 | Yoshihara | H01H 51/2209 | 335/281 |
| 8,344,833 B1 * | 1/2013 | Baldauf | H01R 4/027 | 335/202 |
| 8,947,183 B2 * | 2/2015 | Yano | H01H 50/54 | 335/202 |
| 2009/0096559 A1 * | 4/2009 | Yano | H01H 9/443 | 335/187 |

* cited by examiner

*Primary Examiner* — Alexander Talpalatski
(74) *Attorney, Agent, or Firm* — Stoel Rives LLP

(57) ABSTRACT

The present invention relates to the field of electrical relays. In particular the invention relates to a bracket a relay and bracket combination which permits the relay to be mounted on a surface or panel in a plurality of angular rotational orientations. There is provided a relay and mounting bracket combination comprising a relay having a body with a terminal end portion provided with one or more electrical terminal connectors and a base end portion adapted for engagement with the bracket, wherein the bracket is provided with attachment features which facilitate the mounting of the bracket to an external object or surface when the bracket is engaged with the base end portion of the relay.

17 Claims, 5 Drawing Sheets

ELECTRICAL RELAY WITH MOUNTING BRACKET

RELATED APPLICATIONS

This application claims priority to United Kingdom Application No. 1717667.1, filed on Oct. 25, 2017 and titled, "Electrical Relay with Mounting Bracket," which is hereby incorporated by reference in its entirety.

TECHNICAL FIELD

The present invention relates to the field of electrical relays such as heavy-duty relays, also known as contactors. In particular the invention relates to a relay and mounting bracket combination which permits the relay to be mounted on a surface or panel in one of a plurality of angular rotational orientations with respect to the bracket.

BRIEF DESCRIPTION OF THE DRAWINGS

Following is a description by way of example only and with reference to the figures of the drawings of modes for putting the invention into practice. In the figures.

DETAILED DESCRIPTION

Figure 1A:
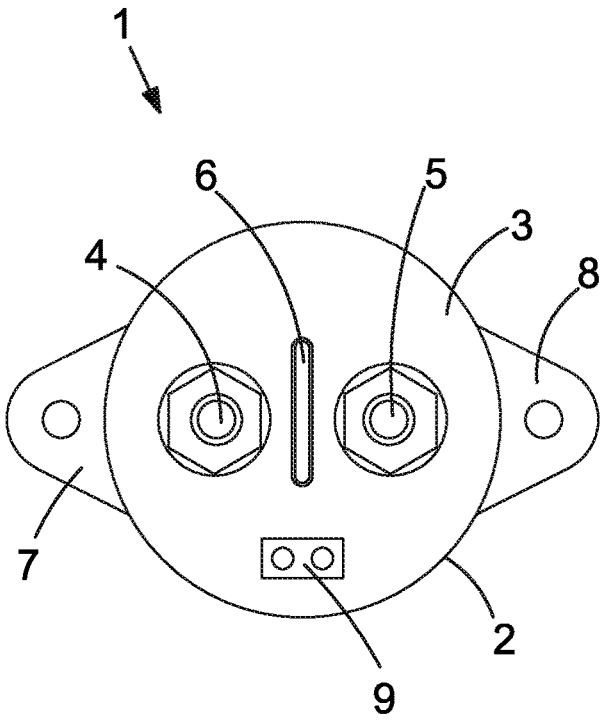
FIG. 1A is a top plan view of a heavy duty relay with a fixed bracket for panel mounting.
Figure 1B:
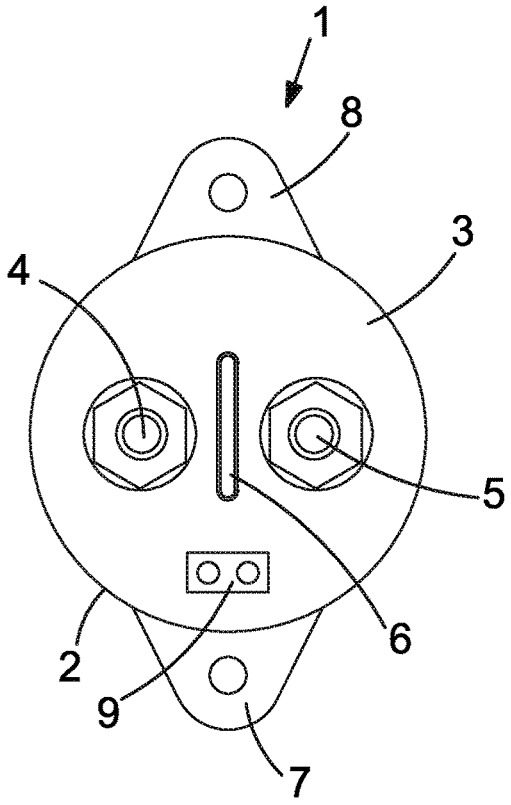
FIG. 1B is a top plan view of a similar relay with a fixed bracket having an alternative rotational orientation.

Devices such as contactors or heavy duty relays generally have mounting brackets or mounting holes the position of which is fixed in relation to other important features of the device such as the main terminals or coil terminals. Two examples of relays having fixed bracket orientations (90 degrees rotational variation) are shown in FIGS. 1A and 1B. Of course the fixed positions of the bracket mounting holes with respect to the terminal locations or orientations do not always suit the layout of the panel or represent the best orientation for the device's terminals to be connected with external electrical connectors in a circuit. This can be a problem if, for example, the brackets have been pre-bored, or pre-bored with insufficient precision, or if there is insufficient space for alternative bore orientations to be formed.

One solution is to make several variants of the relay brackets with each having a different relay orientation, but this is expensive and requires stockists or installers to maintain a range of brackets. Alternatively a bracket with multiple attachment bores (i.e. having a large amount of rotational symmetry) could be made, but this may render the bracket too bulky to fit in spatially constrained locations.

The present invention seeks to provide a relay and mounting bracket combination which permits an installer to select one of a range of relay rotational orientations with respect to the associated mounting bracket, but without the aforementioned cost and bulk compromises.

According to one aspect of the invention there is provided a relay and mounting bracket combination comprising a relay having a body with a longitudinal axis defined between a terminal end portion provided with one or more electrical terminal connectors and a base end portion adapted for engagement with the bracket, wherein the bracket is provided with one or more attachment features which facilitate the mounting of the bracket to an external object or surface when the bracket is engaged with the base end portion of the relay.

The engagement between the base end portion and the bracket is made by the inter-engagement of one or more protruding nubs with one or more constraint features thereby providing axial constraint against withdrawing of the base end portion from engagement with the bracket, said one or more nubs and one or more constraint features being configured so as to be capable of co-operating at any one of a plurality of rotational orientations of the base end portion with respect to the bracket, whereby the relay may be mounted on the bracket in a selected one of a plurality of rotational orientations.

The one or more nubs are typically provided on or in the relay base end portion. The one or more constraint features are typically provided on or in the mounting bracket.

The bracket may comprise a member which defines a generally cylindrical aperture or seat sized to accommodate the base end portion therein. The member is preferably generally annular in form. The aperture or seat is preferably provided with said one or more constraint feature, for example on an inner surface of said seat or aperture.

Said one or more protruding nubs are preferably radially extending and can be any shape which permits it to snag a counterpart constraint feature. Said one or more protruding nubs may be radially extending from the base end portion, for example radially extending outwardly from an outside surface of the base end portion.

In a preferred arrangement a constraint feature comprises an annular lip or shoulder provided on or in the annular aperture or seat of the bracket. The one or more nubs may be provided projecting radially outward from the base end portion of the relay. The lip or shoulder thus provides constraint against axial displacement of the nub or nubs through a continuous range of relay body rotational positions with respect to the bracket. Of course the annular lip or shoulder may be interrupted by one or more bypass features (such as axial slots) which permit the nub or nubs to bypass the constraint feature before being rotated and drawn back into engagement under the lip or against the shoulder.

At least a portion of the nub-facing side of the lip or shoulder may be provided with a surface treatment which promotes mechanical keying of the nub and lip or shoulder, such as surface roughening or texturing, and/or the nub itself may also be provided with a surface treatment for the same purpose. The surface treatment may be the provision of inter-engaging surface features, such as saw tooth profile elements.

In another preferred arrangement the constraint features may comprise a series of circumferentially spaced-apart discrete recesses formed on an inside wall of the bracket aperture or seat. The engagement of a nub and a recess provides constraint against axial movement of the nub and each recess corresponds to a discrete rotational position of the relay body with respect to the bracket. There may be at least four such recesses, preferably at least 8, and more preferably at least 12.

Each recess typically comprises a roof portion which provides axial constraint. There may be side walls which provide rotational constraint, and an open base portion which permits entry of the nub into the recess.

The nubs are preferably each sized and configured to be a sliding fit in each recess.

In another aspect of the invention the one or more nubs have an axial depth which is greater than an axial space provided between the associated constraint feature and a surface to which the bracket is to be mounted. Thus when the bracket is placed base edge-on to the surface and fixed with the base edge flush to the surface, a nub in the constraint feature will be compressed between the constraint feature and the flush surface. In this way the nub or nubs may be clamped tightly against movement.

In yet another aspect of the invention one or more open slots are provided for the nub or nubs to bypass the constraint feature when rotationally aligned with the open slot or slots, after which the nub or nubs may be rotationally displaced (by rotating the relay with respect to the bracket) so as to become aligned with a position in which the nub or nubs can be axially constrained by a constraint feature or features. The relay and bracket are then moved axially apart so that the nub or nubs enter into the appropriate constraint feature or features.

The bracket is preferably a generally annular member having an inside surface which defines the aforementioned annular aperture. Said one or more open slots may be provided in said inside surface, and said one or more nubs may be provided projecting radially outwardly from the base end portion of the relay.

In a preferred arrangement there are two slots and two corresponding nubs, which slots and nubs may be positioned in a diametrically opposed configuration.

The base end portion of the relay body may be generally cylindrical. The body is preferably sized (typically the outside diameter) to be a sliding fit in the annular aperture. The constraint feature or features may be provided on the inside surface of the annular aperture.

The bracket is preferably a unitary member, so as to provide simplicity and no assembly at the point of installation (other than engagement with the relay).

The bracket attachment features may comprise two or more radial, outwardly projecting cheek portions. Each cheek may be provided with a bore in which a screw, bolt or rivet may be disposed for fixing to an underlying surface. Other fixing means may be utilized such as gluing, or brazing or spot or pressure welding, in which case a bore may not be needed.

In a further aspect of the invention there is provided a combination of a relay and mounting bracket comprising a relay having a body with a terminal end portion provided with one or more electrical terminal connectors and a base end portion adapted for engagement with the bracket, wherein the bracket is provided with one or more attachment features which facilitate the mounting of the bracket to an external object or surface when the bracket is engaged with the base end portion of the relay, wherein an engagement between the base end portion and the bracket is made by the co-operation of one or more protruding nubs with one or more constraint features which provide axial constraint against withdrawing of the base end portion from the bracket aperture or seat, wherein the bracket comprises a generally annular member which defines a cylindrical aperture or seat sized to accommodate the base end portion therein, and wherein the body portion is provided with said one or more protruding nub or nubs are radially extending and are each radially oversized with respect to the radius of the bracket aperture or seat, the aperture or seat having an inside surface provided with one or more axially extending open bypass slots each capable of receiving an oversized nub when circumferentially aligned therewith, so that the base end portion may axially enter the bracket aperture or recess with the nubs passing through the slots, and wherein said inside surface of the aperture or recess is further provided with one or more inwardly directed shoulder features, sized to accommodate the nub or nubs therein but providing axial constraint which prevents axial withdrawal of the nub or nubs when the shoulder feature covers the nub, the arrangement being such that the relay base portion may be engaged with the bracket by aligning the nub or nubs with the axial slots, and then twisting the bracket with respect to the base portion so that the nub or nubs are accommodated in a shoulder feature or features, which shoulder feature or features prevent axial disengagement of the base portion from the bracket by acting upon the nub or nubs.

Each nub may have any shape capable of snagging a constraint feature, but each preferably has the form of a generally rectilinear section block having the form of annular sector. Each recess for constraining the nub preferably has the form of an annular sector cut-out in the aperture inside surface.

The terminal end portion of the relay is in certain embodiments typically too large to be passed through the bracket aperture, so that the bracket cannot pass beyond the terminal end portion. This means that the bracket can only be engaged with the relay base portion after passing the base portion and being drawn back onto the base portion and its associated nub or nubs.

In FIG. 1A a heavy duty relay (also known as a contactor) is shown generally as 1. The relay comprises a generally cylindrical body portion 2 having a top face 3 which is provided with two upstanding diametrically spaced apart screw threaded main terminals 4,5 each provided with a nut and spring washer. A central upstanding fin 6 is disposed equidistant between the main terminals (a similar arrangement is shown in FIG. 2). A pair of electromagnetic coil terminals 9 (for activating the device) are upstanding from one side of the top face. A base region of the device is provided with a fixed mounting bracket which includes two diametrically opposed cheek portions 7,8. The cheek portions are each provided with a vertical mounting bore. The device may be attached to an underlying panel (or some other mounting location) by means of screws or bolts or rivets or the like (not shown). A variant of the device is shown in FIG. 1B in which the fixed mounting bracket has an orientation 90 degrees offset as compared to the device of FIG. 1B.

First Embodiment

A first embodiment of a combination heavy duty relay 10 and a mounting bracket 11 is shown in FIG. 2. The relay 10 has a cylindrical body portion 12. The cylindrical body portion has a base region 13 provided with two diametrically opposed nubs in the form of square section, curved sector blocks 14 (only one visible in FIG. 2). projecting radially from the body portion surface. There is a cylindrical upper body portion 20 which is provided with two upstanding screw threaded main terminals 24, 25 which are provided with associated mounting nuts and spring washers. There is a central upstanding fin 26 to prevent shorting of terminal contacts between the terminals. The upper body portion in this embodiment is larger in diameter than the body portion 13 below, so a shoulder 22 is formed at the junction of the two portions.

Figure 2A:
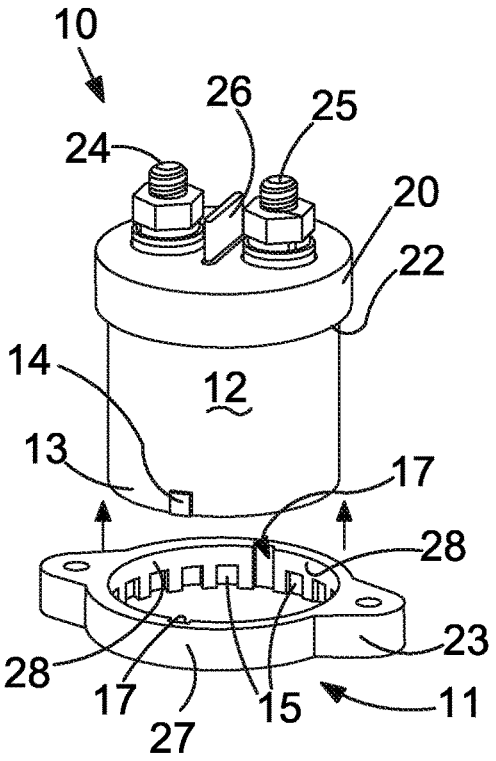
FIG. 2A is an isometric three quarter view from above of a relay and bracket combination in accordance with a first embodiment of the present invention, the combination in a first configuration.
Figure 2B:
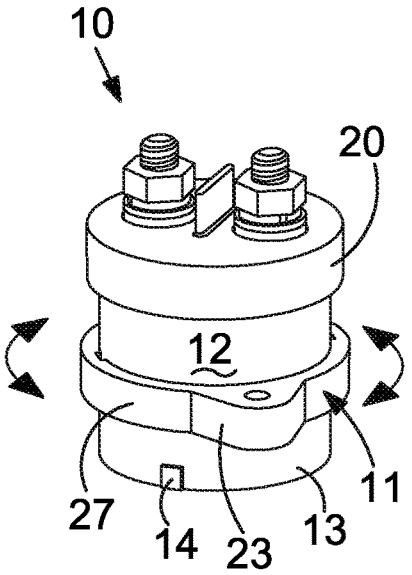
FIG. 2B is an isometric three quarter view of the combination of FIG. 2A in a second configuration.
Figure 2C:
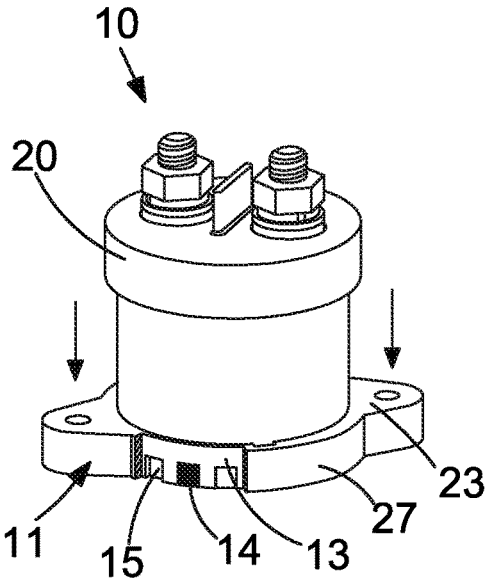
FIG. 2C is an isometric three quarter view of the combination of FIG. 2A in a third configuration.
Figure 3A:
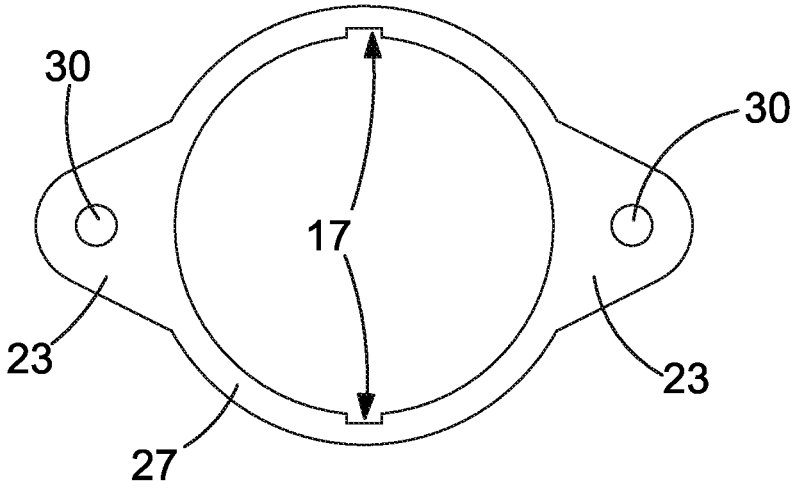
FIG. 3A is a top plan view of the bracket shown in FIG. 2.
Figure 3B:
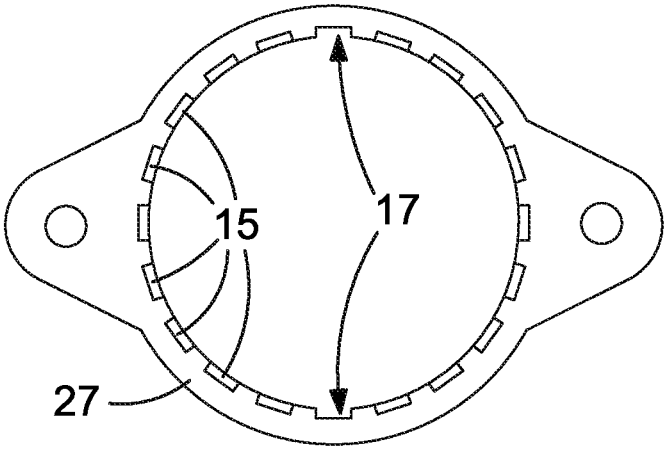
FIG. 3B is an underside plan view of the same bracket.

A mounting bracket is a unitary cast or moulded generally annular member 27 which is formed with diametrically opposed cheek portions 23, each with a bore 30 best seen in FIGS. 3A and 3B. The annular member has an inside cylindrical surface 28 which is sized to provide a sliding fit for the body portion 12 of the relay. The shoulder 22 prevents the relay from falling through the bracket. The inside surface 28 is formed with a series of downward opening inset recesses or pockets 15 (see also FIG. 3B), each having a rectilinear circular sector form which is sized to match and accommodate blocks 14 therein. The inside surface is also formed with two diametrically opposed bypass slots 17 (see FIG. 3A) which are recessed into the member surface and are open at both ends. These slots 17 are sized and disposed so as to align and co-operate with the blocks 14 when the bracket and relay are manipulated into a bypass orientation. In this orientation the bracket 27 may be slipped onto the base region 13 of the relay body, with the blocks passing through the bypass slots 17 as shown in FIG. 2A until the bracket is sits around the body portion 12, per FIG. 2B. The bracket is then free to be rotated with respect to the body portion. Once a desired orientation has been achieved, the bracket may be axially displaced downwards so that the blocks 14 enter the (closest) aligned recesses 15 and engage therewith, as shown in the cutaway view of FIG. 2C. The bracket is then fixed against rotation with respect to the relay body. When the mounting bracket is fixed to an underlying surface and bolted, riveted or screwed into place the relay is securely retained in the selected orientation. By tailoring the tolerances between blocks 14 and recesses 15 a close, wobble-free sliding or interference fit can be obtained. In one example the blocks 14 are slightly axially taller than the recesses 15, so that when the mounting bracket is secured flush to a flat substrate via the cheek bores, the bracket urges onto a top surface of the blocks so as to hold the relay securely and tightly.

Figure 4:
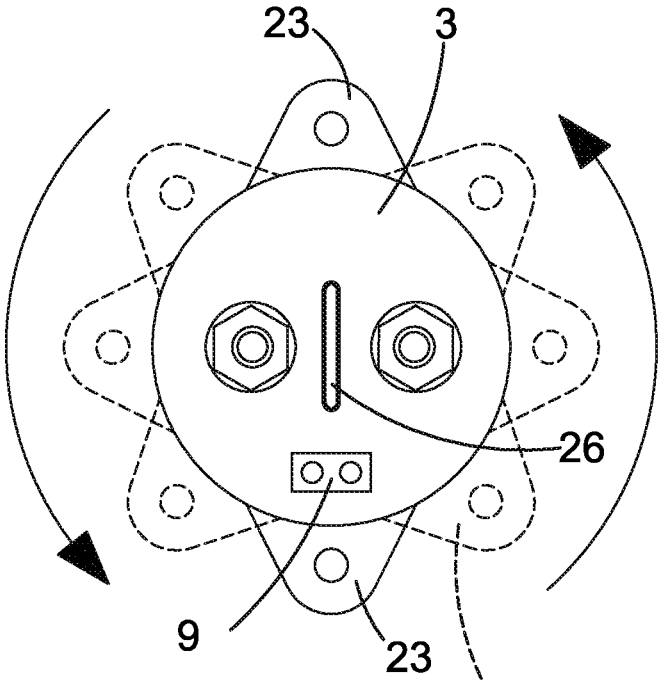
FIG. 4 is a top plan schematic view of a relay and bracket combination in accordance with the present invention.

In this way the bracket orientation can be tailored to a desired one of a range of possible positions corresponding to recess and block pair engagements, as shown in FIG. 4 in which four possible orientations are shown (although more orientations may be available depending upon the number of recess pairs).

Second Embodiment

Figure 5:
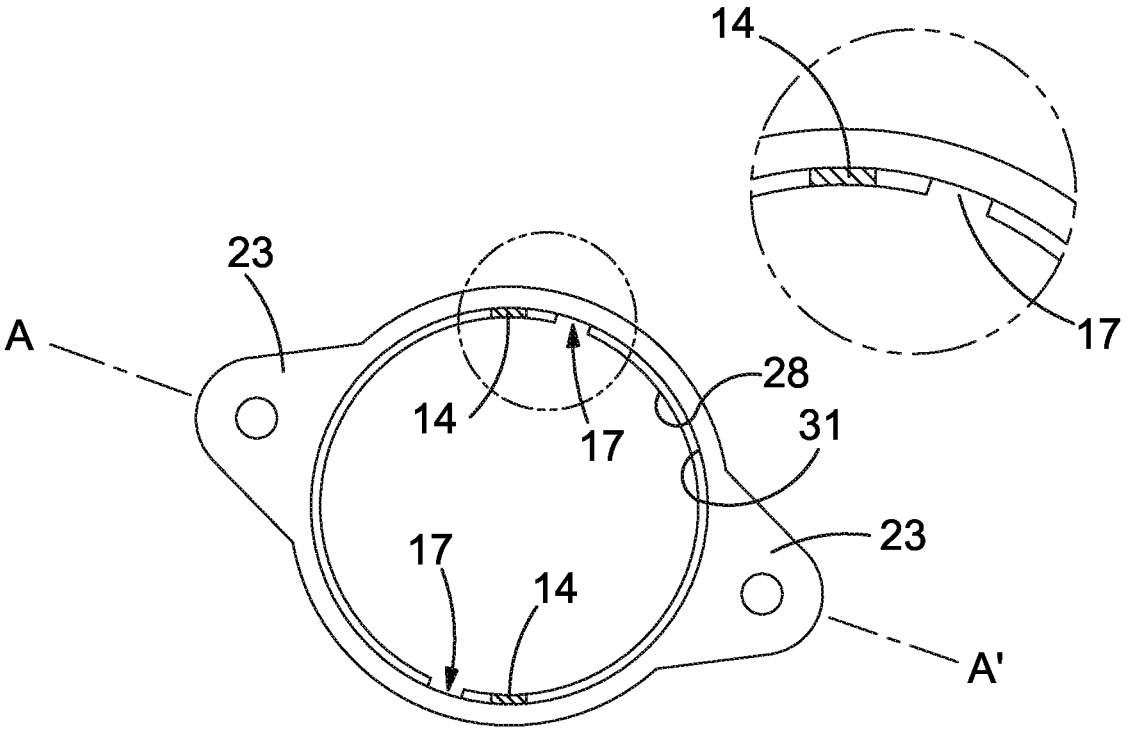
FIG. 5 is an underside view of a bracket used in a bracket and relay combination in accordance with a second embodiment of the invention, showing the location of nubs carried by a relay body (not shown), along with a magnified portion showing the detail of the bracket.
Figure 6A:
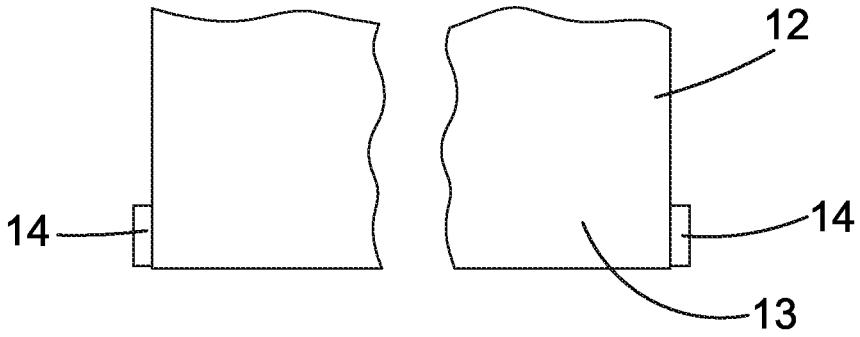
FIG. 6A is part side view of a relay used in the second embodiment.
Figure 6B:
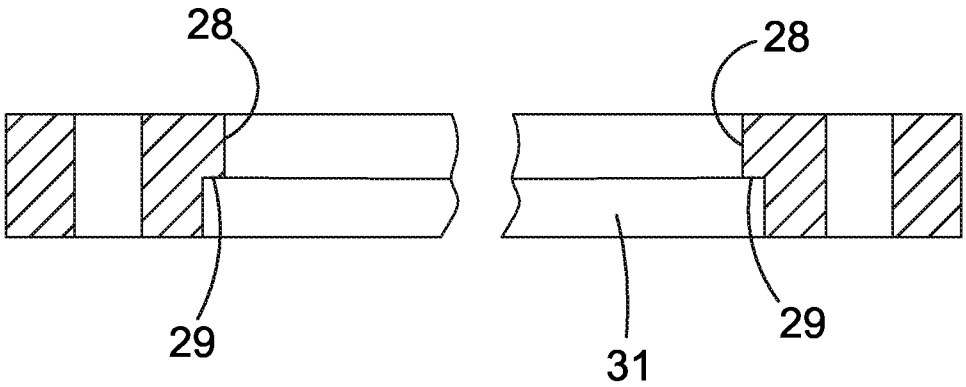
FIG. 6B is a part cross-sectional side view through the plane represented by the line A-A' in FIG. 5.

In this embodiment an alternative bracket (FIG. 5) is used in the combination of mounting bracket and relay. The relay (not shown in FIG. 5) is unchanged and has two nubs (shown as blocks) the position and profile of which is shown at 14. These blocks are radially projecting, as shown in FIG. 6. However, in this embodiment, the inside surface 28 of the bracket member is formed with a continuous annular recess 31 (rather than a series of discrete recess pockets) at a lower end region of the inside surface of the bracket member. This forms an annular shoulder 29 shown in FIG. 6. The pair of axial bypass slots 17 remain and interrupt the annular shoulder at two diametrically opposed locations.

This arrangement operates in a similar way as the first embodiment, with a few important differences. The rotational orientation of the relay is continuously variable as the blocks are free to rotate in the annular recess to adopt a desired relay orientation (leaving aside the bypass slots where there is no constraint). The annular recess of course provides little by way of rotational constraint (in the absence of discrete recess walls which co-operate with the blocks). Thus the surface of the annular shoulder 29 may be roughened or textured or otherwise treated so as to mechanically key or adhere to an upper (co-operating) surface of the blocks 14. This block surface may itself be roughened, textured or otherwise treated to enhance the fixing effect. As with the first embodiment the blocks 14 may have a height which is slightly greater than that of the annular recess, thereby causing the block to be squeezed axially by the shoulder 29 when the bracket is tightened onto the underlying substrate or panel.

In certain aspects the present invention allows a mounting bracket to be attached to a relay or contactor in a chosen orientation, regardless of whether the upper end region of the device has greater bulk or diameter or protrusions or other irregularity which would prevent the bracket from being pulled down over the upper end of the device. In addition to allowing the user to select an optimum mounting orientation/configuration, the combination provides the option of multiple mounting configurations for different applications using only one set of components (i.e. one relay-bracket combination).

In some embodiments, the invention allows the application of a mounting bracket to fit onto a device with an upper portion having a larger diameter or cross sectional area than the bracket aperture. The upper portion of the device may have a regular or irregular cross sectional shape or profile.

In certain embodiments the bracket has a circular hole the diameter of which is greater than the diameter of the lower portion of the device, preferably a sliding fit. The bracket may have slots or recesses disposed such that they coincide with nubs on the device when appropriately rotationally oriented.

The bypass slots are open through the thickness (depth) of the bracket such that the nubs can pass through them without hindrance. On the underside of the bracket there are recesses, the angular spacing of which also coincides with the angular spacings corresponding nubs on the device, but these recesses are blind, i.e. they do not pass through the entire thickness of the bracket. The depth of these blind keyways matches, or is slightly less than the height of the nubs (or blocks) on the device.

It can be seen therefore that the open bypass slots allow the lower end region of the device to be inserted through the hole in the bracket. By rotating the bracket the nubs/blocks on the device can be aligned with any pair of the blind recesses, thus giving multiple angular relationships between device and bracket.

In another aspect of the invention the plurality of discrete blind recesses is replaced by a continuous recess on the underside of the bracket. The depth of this recess would typically be marginally less than the depth of the nubs/blocks. Thus when the bracket is tightened down onto the panel, the clamping action of the bracket onto the nubs/blocks will hold the device secure. The advantage of this alternative is that there are an unlimited number of positions of the bracket relative to the device.

The underside of the recess in the bracket and the inter-facing top surface of the nubs/blocks may have a textured surface to provide a degree of positive mechanical fixing when the bracket is tightened down onto the mounting plate. Other forms of mechanical fixing or keying may be provided, such as by the provision of inter-engaging saw tooth profile elements.

In use the relay body according to certain embodiments or aspects of the invention as hereinbefore described is introduced to the bracket and the base end portion of the relay is axially threaded through the bracket aperture, with the nub or nubs aligned with the bypass slots. Once the nubs have passed the slots, the relay body may be rotated with respect to the bracket until a desired relay body orientation is achieved. In cases where several discrete recesses (or constraint features) are distributed around the aperture (or seat) inner surface, the closest discrete recess to the desired orientation is chosen. In cases where the constraint feature represents a substantially continuous feature (such as an annular lip or shoulder) the desired orientation may be adopted without adjusting to a closest discrete recess. The fixing of the mounting bracket to an underlying surface or substrate serves to fix the bracket to the relay (or vice versa) so that the relay is held in the desired orientation for integration into an electrical circuit. The use of bypass slots avoids the need for the bracket to slide over a top (terminal) end of the relay body when engaging therewith. Hence any terminal end portion shape and configuration can be used, especially those in which the terminal end portion is more bulky, or irregular, than the relay body base end portion which is engaged with the bracket.

In summary, the present invention relates to the field of electrical relays such as heavy duty relays, also known as contactors. In particular the invention relates to a bracket a relay and bracket combination which permits the relay to be mounted on a surface or panel in a plurality of angular rotational orientations. There is provided a relay and mounting bracket combination comprising a relay having a body with a terminal end portion provided with one or more electrical terminal connectors and a base end portion adapted for engagement with the bracket, wherein the bracket is provided with one or more attachment features which facilitate the mounting of the bracket to an external object or surface when the bracket is engaged with the base end portion of the relay, wherein an engagement between the base end portion and the bracket is made by the co-operation of one or more protruding nubs with one or more constraint features which provide axial constraint against withdrawing of the base end portion from the bracket aperture or seat. The bracket is preferably provided with a generally annular aperture or seat sized to accommodate the base end portion therein. The inside surface of the aperture or recess may be provided with at one or more inwardly directed shoulder features, sized to accommodate the nub therein but providing axial constraint which prevents axial withdrawal of the nub when the shoulder feature covers the nub. The arrangement is such that the relay base portion may be engaged with the bracket by aligning the nub or nubs with open axial slots, and then twisting the bracket with respect to the base portion so that the nub is accommodated in a shoulder feature, which shoulder feature blocks disengagement of the base portion from the bracket by acting upon the constrained nub or nubs.

The invention claimed is:

1. A relay and mounting bracket combination comprising a relay having a body with longitudinal axis defined between a terminal end portion provided with one or more electrical terminal connectors and a base end portion adapted for engagement with the bracket, wherein the bracket is provided with one or more attachment features which facilitate the mounting of the bracket to an external object or surface when the bracket is engaged with the base end portion of the relay, wherein the engagement between the base end portion and the bracket is made by the inter-engagement of one or more protruding nubs with one or more constraint features thereby providing axial constraint against withdrawing of the base end portion from engagement with the bracket, said one or more nubs and one or more constraint features being configured so as to be capable of co-operating at any one of a plurality of rotational orientations of the base end portion with respect to the bracket, whereby the relay may be mounted on the bracket in a selected one of a plurality of rotational orientations.

2. A combination as claimed in claim 1 wherein the bracket is provided with a generally annular aperture or seat sized to accommodate the base end portion therein, which aperture or seat is provided with said one or more constraint feature.

3. A combination as claimed in claim 2 wherein said one or more protruding nubs are radially extending from the base end portion.

4. A combination as claimed in claim 2 wherein the constraint feature comprises an annular lip or shoulder provided on or in the annular aperture or seat of the bracket, and said one or more nubs are provided projecting radially outward from the base end portion of the relay with the lip or shoulder providing constraint against axial displacement the nub or nubs through a continuous range of relay body rotational positions with respect to the bracket.

5. A combination as claimed in claim 4 wherein at least a portion of the nub-facing side of the lip or shoulder is provided with a surface treatment which promotes mechanical keying of the nub or nubs with the lip or shoulder, such as surface roughening or texturing or saw tooth profiling.

6. A combination as claimed in claim 2 wherein the constraint features comprise a series of circumferentially spaced-apart discrete recesses formed on an inside wall of the bracket aperture or seat, the engagement of a nub and a recess providing constraint against axial movement of the nub, each recess corresponding to a discrete rotational position of the relay body with respect to the bracket.

7. A combination as claimed in claim 6 wherein each recess comprises a roof portion which provides axial constraint, side walls which provide rotational constraint and an open base portion which permits entry of the nub into the recess.

8. A combination as claimed in claim 6 wherein the nub is sized and configured to be a sliding fit in each recess.

9. A combination as claimed in claim 1 wherein the one or more nubs have an axial height which is greater than an axial space provided between the constraint feature or features and a surface to which the bracket is to be mounted so that when the bracket is placed base edge-on to the surface and fixed with the base edge flush to the surface a nub in the constraint feature will be axially compressed.

10. A combination as claimed in claim 1 wherein one or more open slots are provided for said one or more nubs to bypass the constraint feature or features when rotationally aligned with an open slot, after which the nub may be rotationally displaced so as to become aligned with a position in which the nub can be axially constrained by the constraint feature.

11. A combination as claimed in claim 2 wherein the bracket is a generally annular member having an inside surface which defines the aforementioned annular aperture, said one or more open slots are provided in said inside surface, and said one or more nubs are provided projecting radially outwardly from the base end portion of the relay.

12. A combination as claimed in claim 11 wherein there are two slots and two corresponding nubs.

13. A combination as claimed in claim 2 wherein the base end portion of the relay body is generally cylindrical and sized to be a sliding fit in the annular aperture.

14. A combination as claimed in claim 13 wherein the constraint feature or features are provided on the inside surface of the annular aperture.

15. A combination as claimed in claim 14 wherein the bracket is a unitary member.

16. A combination as claimed in claim 1 wherein the bracket attachment features comprise two or more radial, outwardly projecting cheek portions.

17. A combination as claimed in claim 16 wherein each cheek is provided with a bore in which a screw, bolt or rivet may be disposed for fixing to an underlying surface.

* * * * *